US008607410B2

(12) United States Patent
Mersmann

(10) Patent No.: US 8,607,410 B2
(45) Date of Patent: Dec. 17, 2013

(54) ATTACHMENT DEVICE FOR A VACUUM CLEANER

(75) Inventor: Udo Mersmann, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 0 days.

(21) Appl. No.: 13/617,796

(22) Filed: Sep. 14, 2012

(65) Prior Publication Data

US 2013/0091663 A1 Apr. 18, 2013

(30) Foreign Application Priority Data

Sep. 16, 2011 (DE) ..... 10 2011 053 667

(51) Int. Cl.
*A47L 5/10* (2006.01)

(52) U.S. Cl.
USPC ..... 15/389; 15/391

(58) Field of Classification Search
USPC ..... 15/389, 391, 246.2
IPC ..... A47L 5/10
See application file for complete search history.

(56) References Cited

U.S. PATENT DOCUMENTS

| | | | |
|---|---|---|---|
| 8,166,608 | B2 | 5/2012 | Becker et al. |
| 2002/0104185 | A1 | 8/2002 | Weber et al. |
| 2010/0088835 | A1 | 4/2010 | Crouch et al. |

FOREIGN PATENT DOCUMENTS

| | | | |
|---|---|---|---|
| DE | 8706810 | U1 | 9/1988 |
| EP | 2033560 | A2 | 3/2009 |
| FR | 626484 | A | 9/1927 |
| WO | WO 2004073476 | A1 | 9/2004 |
| WO | WO 2008128751 | A1 | 10/2008 |

*Primary Examiner* — David Redding
(74) *Attorney, Agent, or Firm* — Leydig, Voit & Mayer, Ltd.

(57) ABSTRACT

An attachment device for a vacuum cleaner includes a rotatable roller having at least one of bristles or flap-type agitating members. The rotatable roller has an axis of rotation extending transversely to a direction of advancement of the attachment device or vacuum cleaner. A motor is configured to rotate a motor shaft for driving the roller. The motor shaft extends transversely to the axis of rotation of the roller. A gear housing receives at least a portion of the roller and has an opening into which the motor shaft or a drive shaft coupled to the motor shaft extends.

18 Claims, 4 Drawing Sheets

ATTACHMENT DEVICE FOR A VACUUM CLEANER

CROSS REFERENCE TO RELATED APPLICATIONS

This application claims priority to German Patent Application No. DE 10 2011 053 667, filed Sep. 16, 2011, which is hereby incorporated by reference herein in its entirety.

FIELD

The present invention relates to an attachment device for a vacuum cleaner, including a rotatable roller which is provided with bristles or flap-type agitating members and whose axis of rotation extends transversely to the direction of advancement of the attachment device or of the vacuum cleaner, respectively, and further including a motor which rotates a motor shaft for driving the roller.

BACKGROUND

Attachments including a rotatable roller with bristles or agitating members are generally known. They are used either as a so-called electric floor nozzle, in which case they are attached as a separate part to the suction wand of a vacuum cleaner, or as a base unit permanently mounted on an upright vacuum cleaner. To date, there are known two different driving principles for the roller. The first principle is based on a direct drive motor where the rotor is embodied as a sleeve-shaped part of the roller and is slipped over the stator. In this regard, see, for example, WO 2008/128751 A1. This driving principle has the disadvantage that the motor heats up easily because it is disposed in the closed roller. The supplying of cooling air is not only complex, but also has the disadvantage that the cooling air may be laden with dust particles and, consequently, contaminate the motor from inside.

The second principle uses a motor which is disposed remotely from the roller. The motor shaft and the axis of rotation of the roller extend parallel to each other, and the motor rotation is transmitted via a toothed belt to the roller. This principle is described, for example, in EP 203 35 60 A2. The use of a toothed belt has the disadvantage that the required elasticity of the belt deteriorates with age, which may result in tearing of the belt. Moreover, threads and long hairs wrap around the belt and impair its functioning. Another drawback of a belt drive is that it occupies an area on the roller which is then not available for attachment of bristles or agitating members. Ultimately, the belt must be passed through the roller cover, and thus forms an opening through which negative pressure is lost.

SUMMARY

In an embodiment, the present invention provides an attachment device for a vacuum cleaner includes a rotatable roller having at least one of bristles or flap-type agitating members. The rotatable roller has an axis of rotation extending transversely to a direction of advancement of the attachment device or vacuum cleaner. A motor is configured to rotate a motor shaft for driving the roller. The motor shaft extends transversely to the axis of rotation of the roller. A gear housing receives at least a portion of the roller and has an opening into which the motor shaft or a drive shaft coupled to the motor shaft extends.

BRIEF DESCRIPTION OF THE DRAWINGS

Exemplary embodiments of the present invention are described in more detail below and schematically shown in the drawings, in which.

DETAILED DESCRIPTION

Figure 1:
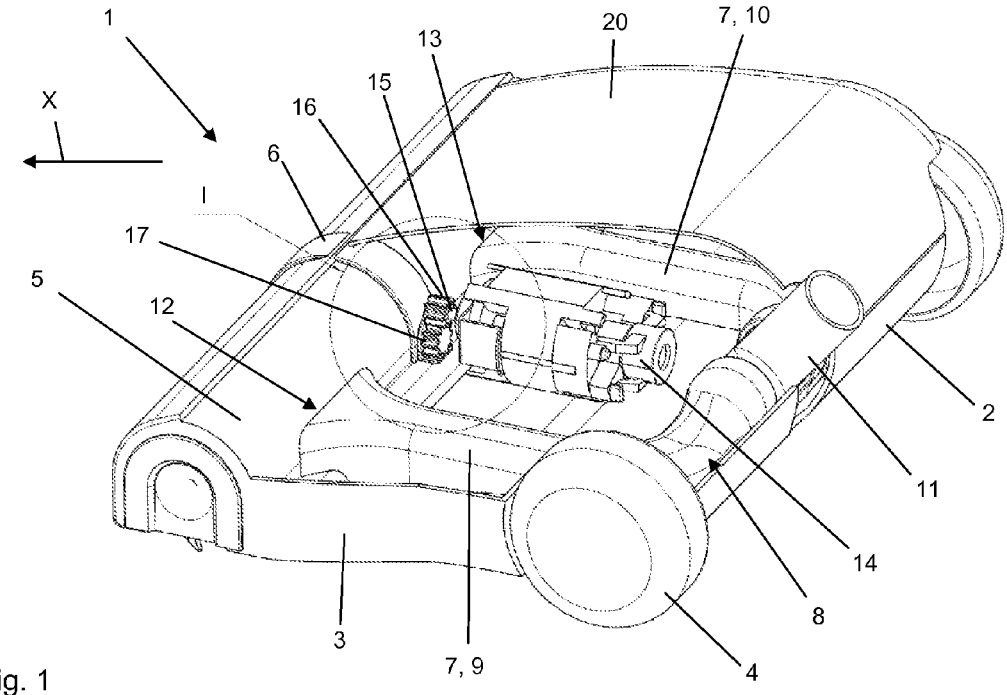
FIGS. 1 and 1*a* are perspective views of an electric floor nozzle configured in accordance with an embodiment of the present invention.

In an embodiment, the present invention provides an attachment device of the above-mentioned type which avoids the disadvantages of the prior art and makes it possible to achieve a good cleaning result.

Advantages of the present invention are achieved in that the motor shaft extends transversely to the axis of rotation of the roller. This allows the roller to be driven by a relatively thin and rigid shaft, which avoids the disadvantages of an elastic belt.

In a particularly advantageous embodiment, the roller is disposed under a roller cover, and the motor shaft, or a drive shaft coupled to the motor shaft, extends through an opening in the roller cover. The opening can then be matched to the shaft, or vice versa, in such a way that there is only a small gap. This gap can be further minimized by suitable sealing means (lubrication, plain bearings, or the like), so that passage of dust or dirt from the area of the roller to the motor is virtually no longer possible. In order to render the negative pressure profile more uniform across the length of the entire attachment device, it is advantageous if the roller cover has a plurality of suction openings formed therein. The pressure profile is particularly uniform when the suction openings divide the roller cover into sections at least approximately equal in length. If two roller parts of at least approximately equal length are used, it is sufficient to provide two suction openings in the roller cover. Moreover, it is advantageous if the suction openings are connected via an air duct to a common suction air outlet.

It is also particularly advantageous if at least a portion of the roller is received by a bearing housing, and if the motor shaft, or a drive shaft coupled to the motor shaft, extends through an opening in the bearing housing. Here, too, the opening can then be matched to the shaft, or vice versa, in such a way that there is only a small gap therebetween. This gap can be further minimized by suitable sealing means (lubrication, plain bearings, or the like), so that passage of dust or dirt into the drive and bearing mechanism of the roller is virtually no longer possible. The bearing housing may advantageously be ring-shaped. It is also expedient if the bearing housing is received by the roller cover, which is preferably U-shaped in cross section. Moreover, it is advantageous if the roller is of two-part construction and the bearing housing is disposed between the roller parts. By dividing the roller, the parts to be balanced become shorter, which in turn makes balancing easier. The two roller parts can be floatingly supported which, however, is technically very complex and difficult to implement, or be supported by additional bearings at the two roller part ends. The bearing arrangement and the suction air path, which will be described later herein, are easiest to implement when the roller parts are at least approximately equal in length.

Due to the high resistance to rotation of the bristles against the surface to be worked on, especially carpet, it is common to use high rpm motors. In contrast, the speed of rotation of the roller should not be too high. Therefore, it is expedient that the motor or drive shaft drive the roller via a gear mechanism. In this connection, it is particularly advantageous if the gear mechanism is disposed in the bearing housing in order to protect it from dust and dirt. The gear mechanism should preferably be designed such that both roller parts rotate in the same direction.

It is also advantageous if the bristles or agitator portions adjacent to the bearing housing point toward the motor or drive shaft, or even better, if they contact the motor or drive shaft during rotation of the roller. This prevents unbrushed areas.

It is also particularly advantageous if parts of the gear mechanism, in particular gears of the gear mechanism, extend at least partially into the roller or roller parts. This not only provides better protection of the gear mechanism components from dust and dirt, but also allows for a more compact design of the gear housing. This makes it possible to further reduce unbrushed areas.

Figure 1A:
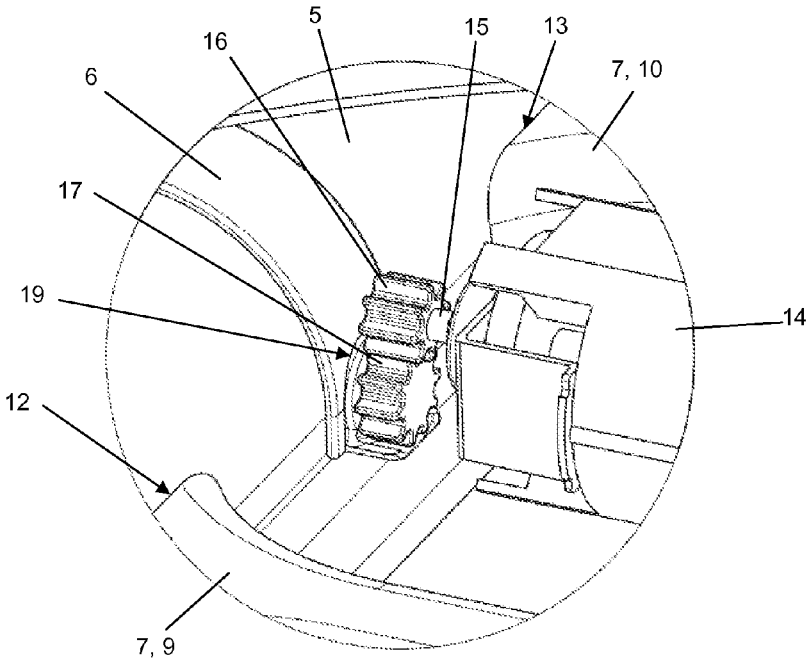

The inventive design of an attachment device according to an embodiment of the present invention for use with a vacuum cleaner will now be described using the example of an electric floor nozzle 1. FIG. 1 shows such a vacuum cleaner accessory. Nozzle 1 includes a sole plate 2 which has a raised edge portion 3 at the sides and is provided with a carriage. The carriage includes rear wheels 4 and front wheels. The front wheels may in some cases be dispensed with. In the front region, as viewed in the direction of advancement (indicated by arrow X), sole plate 2 merges into a roller cover 5, which is U-shaped in cross section. In the middle of roller cover 5, there is a strip-shaped enlargement 6, whose function will be explained later. Also visible in FIG. 1 are upper walls 7 of a two-branch air duct 8. Both branches 9 and 10 are connected via coupling points to a suction air outlet 11 in the rear region, as viewed in the direction of advancement. Suction air outlet 11 also serves as an adapter for connection to the suction wand of a vacuum cleaner. In the front region, branches 9 and 10 open into roller cover 5, where they form two suction openings 12 and 13. In order to generate a suction air stream of greatest possible uniformity across the width of electric floor nozzle 1, suction openings 12 and 13 divide roller cover 5 into sections at least approximately equal in length. A motor 14 is disposed on sole plate 2 in the space that is bounded at the front by roller cover 5 and otherwise by the two air duct branches 9 and 10. Motor shaft 15 has mounted thereon a pinion 16, which meshes with a gear 17. Gear 17 is mounted on the end of a drive shaft 18 (see also FIGS. 2 and 3), which is passed through an opening 19 in roller cover 19 in the region of enlargement 6. Here, only the edge of said opening is discernible (see also the enlarged view of detail I in FIG. 1*a*). A continuous motor shaft could also be used in place of a separate drive shaft 18. Electric floor nozzle 1 is closed at the top by a top cover 20, only one half of which is shown in FIG. 1.

Figure 2:
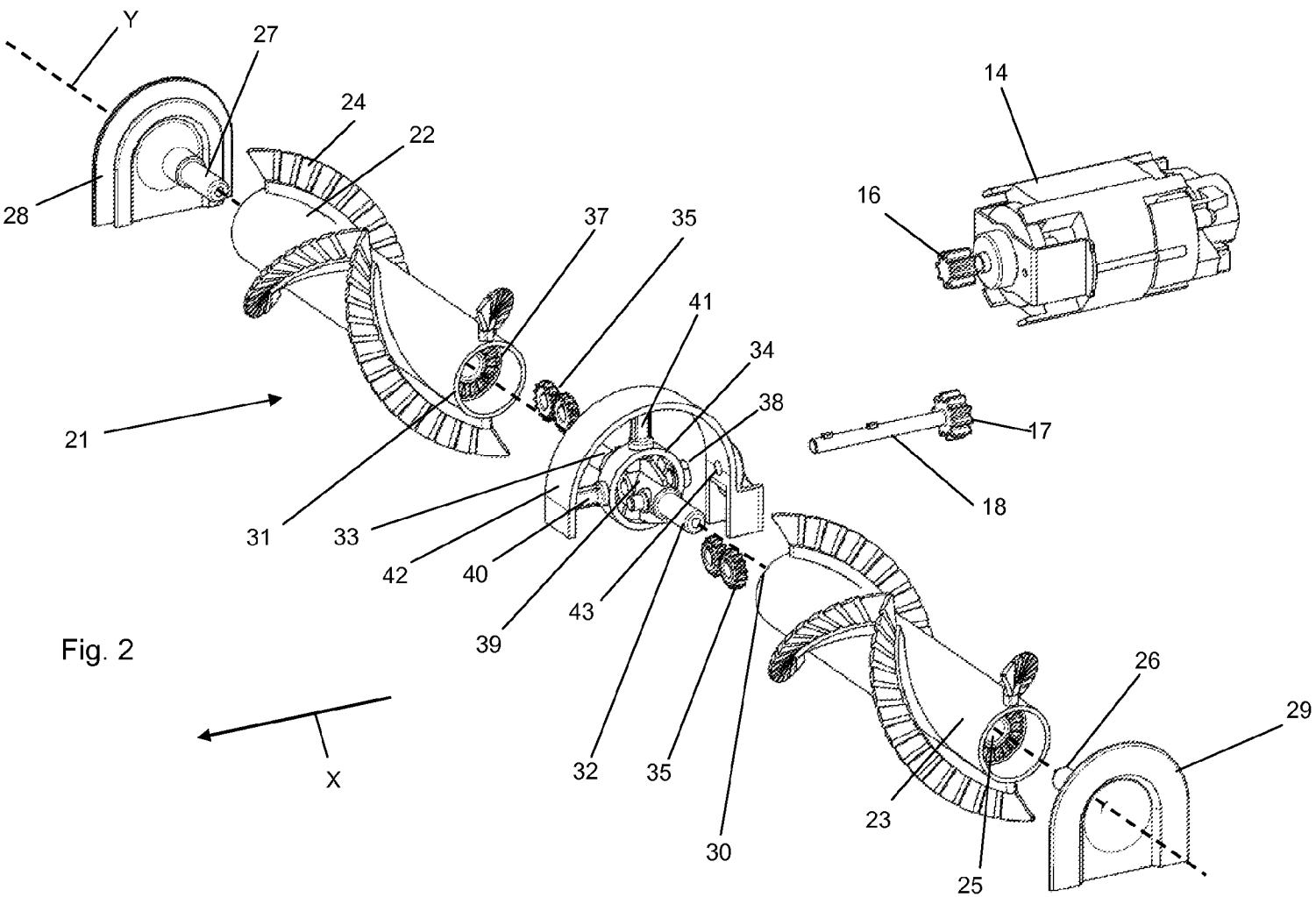
FIG. 2 is an exploded view of the brush roller and its drive components of the electric floor nozzle.

FIG. 2 shows the design of a brush roller 21 in an exploded view. Brush roller 21 is disposed below the roller cover 5 depicted in FIG. 5. The brush roller has a two-part design including two cylindrical roller parts 22 and 23 of equal length, which are provided with rows of bristles 24 thereabout. Flaps or other suitable agitating members may be used in place of the bristles. Both roller parts 22 and 23 are rotatably supported and have a common axis of rotation Y extending transversely to the direction of advancement X. Rotatable support at the outward ends of roller parts 22 and 23 is accomplished in that they have radial roller bearings disposed therein (not shown), and in that they are placed with their openings 25 onto outer pins 26 and 27, which are, in turn, integrally formed on cover plates 28 and 29. Inward ends 30 and 31 of roller parts 22 and 23 are also provided with bearings, which are placed onto inner pins 32 and 33. These pins 32 and 33 are fixed in a ring-shaped gear housing 34. Holder 39 of inner pins 32 and 33 also carries gears 35 as parts of a gear mechanism 36 (see FIGS. 3, 3*a*), which is coupled at its driven end to drive shaft 18, and at its driving end to teeth 37 provided on roller parts 22 and 23. To this end, drive end 18 extends through an opening 38 in the gear housing. Gear mechanism 36 is designed such that both roller parts 22 and 23 are rotated in the same direction. Apart from that, any suitable gear mechanism 36 may be used which fulfills this condition. The design of such a gear mechanism 36 is know to those skilled in the art and will therefore not be further described herein. The gear ratio should be selected such that the ratio between the speed of rotation of the brush roller and the motor speed is about 1:3, depending on the type of the motor. In the assembled state, stationary gear housing 34 surrounds the rotatable ends 30 and 31 of roller parts 22 and 23 with the least possible clearance, so that ingress of dirt into the interior of the gear housing is prevented to the extent possible. Similarly, opening 38 in gear housing 34, through which drive shaft 18 extends into the area of the gear mechanism, has only a small clearance with respect to the diameter of shaft 18 and is sealed against dirt and dust to the extent possible. FIG. 2 further shows that gear housing 34 is fixed to a U-shaped holding bracket 42 by two spokes 40 and 41. This holding bracket is also penetrated by drive shaft 18 at a suitable opening 43. All openings 38, 43 and 19 in the roller cover, the gear housing and the holding bracket are arranged in line with each other. The holding bracket is received by the strip-shaped enlargement in roller cover 5 in form-fitting relationship therewith.

Figure 3:
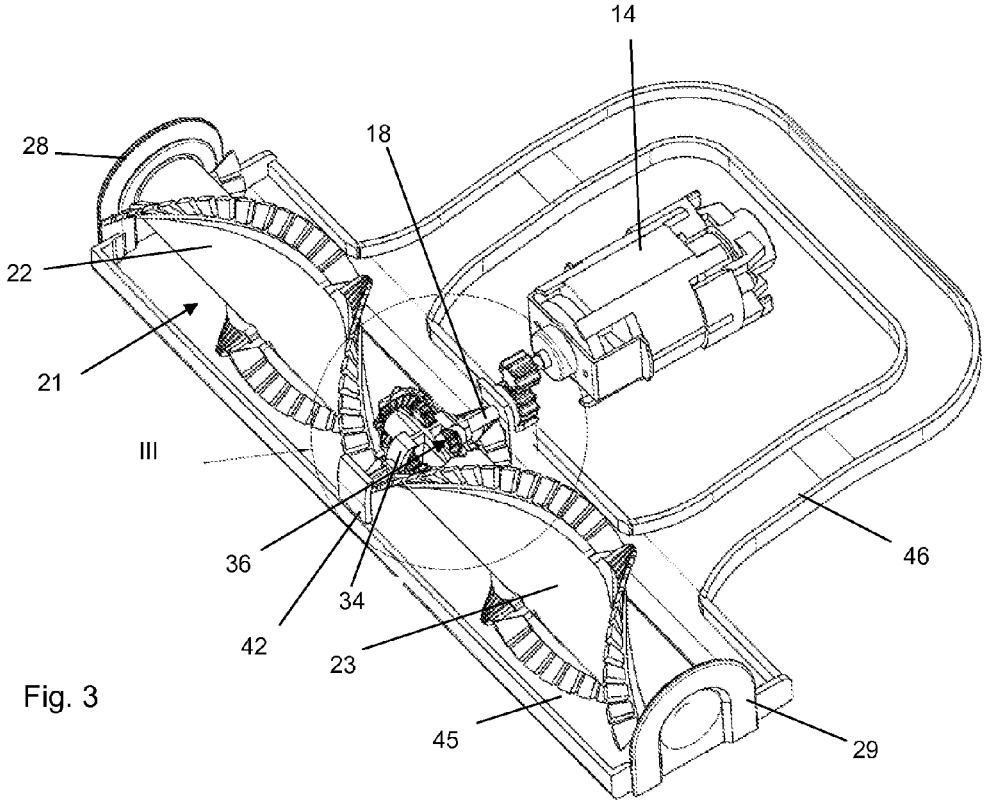
FIGS. 3 and 3*a* are views of the brush module of the electric floor nozzle.
Figure 3A:
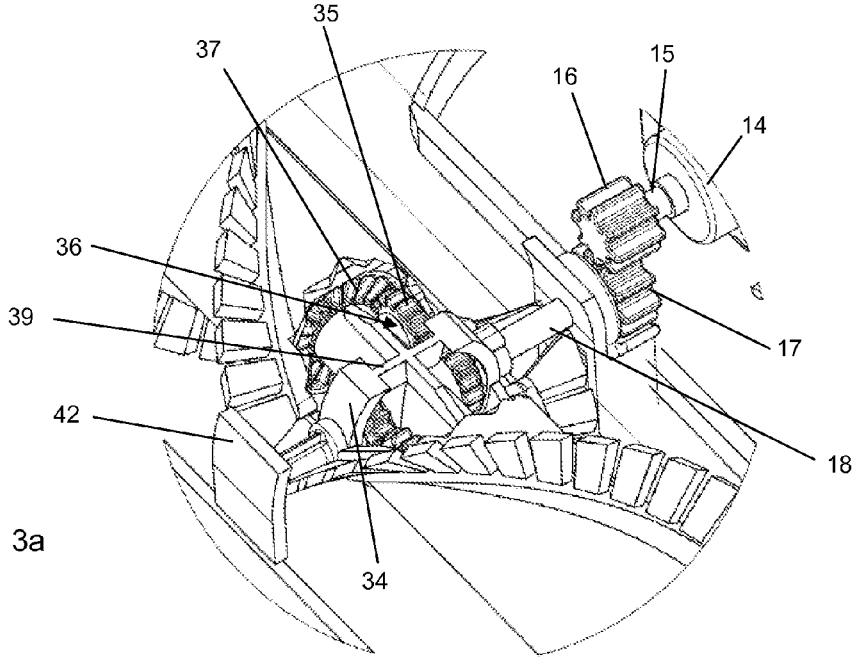

FIGS. 3 and 3*a* illustrate a brush module 44. Brush module 44 includes brush roller 22, the holding and bearing arrangement thereof, and a holding device provided for this purpose. The entire module 44 can be removed from electric floor nozzle 1 with a few manual operations to allow removal of threads that may have become wound around the brush roller, or of parts that may block the roller from rotating. The holding device is composed of a rectangular holding frame 45 to which are attached the two cover plates 28 and 29, as well as holding bracket 42. A C-handle-shaped cover member 46 for air duct 8 is integrally formed on holding frame 45. Motor 14 is also shown in FIG. 3 to indicate that it serves to drive roller 21. FIG. 3*a* is an enlarged view of the detail III showing the gear mechanism 36, which transmits the rotation of motor shaft 15 to drive shaft 18, and then to the two roller parts 22 and 23. As can be readily seen here, motor shaft 15 and drive shaft 18 are oriented perpendicular to axis of rotation Y of brush roller 21. In both of FIGS. 3 and 3*a*, gear housing 34 and holding bracket 42 have been removed to allow a better view of gear mechanism 36.

It can also be seen in FIG. 3 and FIG. 3*a* that gear mechanism 36 is partially received and enclosed by roller 21 or roller parts 22, 23. Furthermore, FIG. 2 shows that gears 35, as part of gear mechanism 36, are at least partially disposed within roller 21 or roller parts 22, 23.

Figure 4:
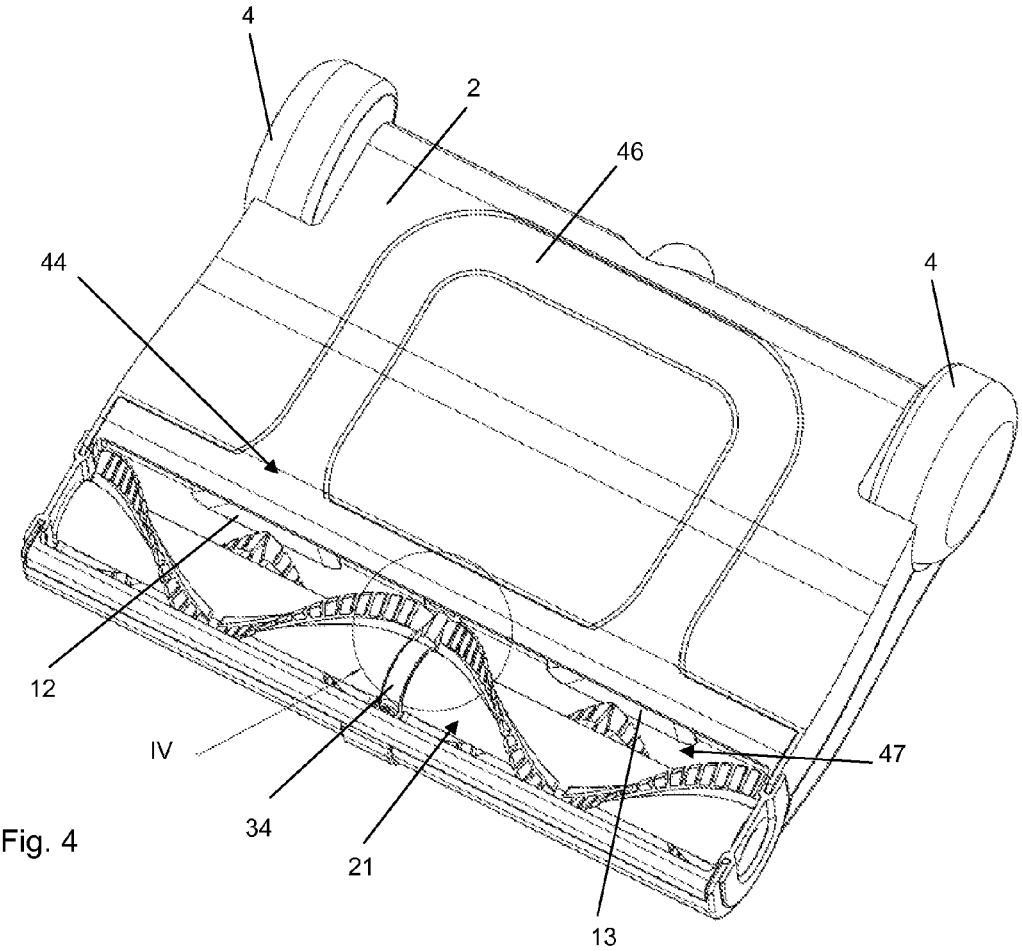
FIGS. 4 and 4*a* are views showing the electric floor nozzle from below.
Figure 4A:
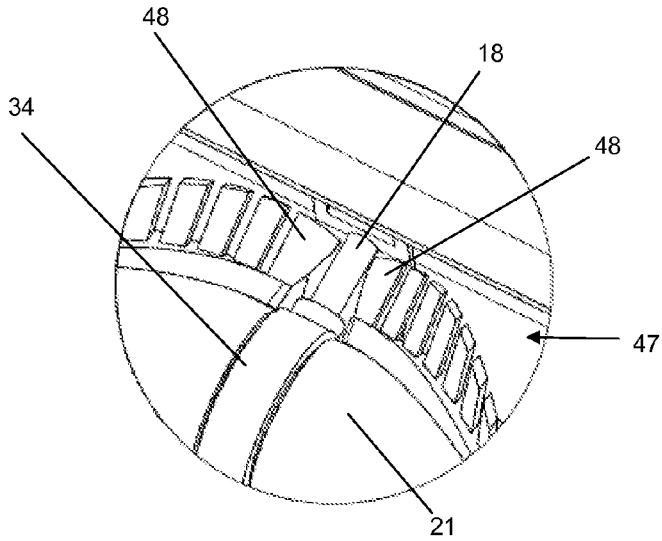

FIGS. 4 and 4*a* show brush module 44 in the installed position. As shown here, cover member 46 completes the upper walls 7 of air duct 8 to form a closed tube. Also discernible are the two suction openings 12 and 13, which are adapted to receive the dirt loosened by brush roller 21. Brush roller 21 projects through a rectangular opening 47 in holding frame 45, and thus is in contact with the floor surface to be worked on. As can be seen particularly well in FIG. 4*a*, which shows an enlarged view of detail IV, the bristles 48 adjacent to gear housing 34 point toward drive shaft 18 to a point where they contact it during rotation of roller 21. In this way, no unbrushed strip will remain in the central region of floor nozzle 1 as the floor nozzle is moved forward.

FIG. 4 also shows that drive shaft 18 is exposed. Because of this, the adjacent bristles 48 or agitator portions contact drive shaft 18. This arrangement allows cleaning of drive shaft 18, thereby preventing dust from depositing thereon.

Moreover, it can be seen in FIG. 4 that the adjacent bristles 48 or agitator portions of roller parts 22, 23 are arranged such that they contact each other. As a result of the oblique arrangement of the adjacent bristles 48 or agitator portions relative to one another, the adjacent bristles 48 or agitator portions of roller parts 22, 23 overlap each other in those regions in which they do not contact drive shaft 18. In this manner, unbrushed areas are further minimized.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the attached claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise.

LIST OF REFERENCE NUMERALS

1 electric floor nozzle
2 sole plate
3 edge portion
4 rear wheels
5 roller cover
6 strip-shaped enlargement
7 upper walls
8 air duct
9 air duct branch
10 air duct branch
11 suction air outlet
12 suction opening
13 suction opening
14 motor
15 motor shaft
16 motor pinion
17 gear
18 drive shaft
19 opening in the roller cover
20 top cover
21 brush roller
22 roller part
23 roller part
24 rows of bristles
25 openings
26 outer pin
27 outer pin
28 cover plate
29 cover plate
30 inner end of roller part
31 inner end of roller part
32 inner pin
33 inner pin
34 gear housing
35 gears
36 gear mechanism
37 teeth
38 opening in the gear housing
39 holder of inner pins
40 spoke
41 spoke
42 holding bracket
43 opening in the holding bracket
44 brush module
45 holding frame
46 cover member
47 opening in the holding frame
48 bristles

What is claimed is:

1. An attachment device for a vacuum cleaner, the attachment device comprising:

a rotatable roller including at least one of bristles or flap-type agitating members, the rotatable roller having an axis of rotation extending transversely to a direction of advancement of the attachment device or vacuum cleaner;

a motor configured to rotate a motor shaft for driving the roller, the motor shaft extending transversely to the axis of rotation of the roller; and a gear housing receiving at least a portion of the roller and having an opening into which the motor shaft or a drive shaft coupled to the motor shaft extends.

2. The attachment device as recited in claim 1, wherein the roller is disposed under a roller cover; and wherein the motor shaft or drive shaft coupled to the motor shaft extends into the gear housing through an opening in the roller cover.

3. The attachment device as recited in claim 2, wherein the roller cover includes a plurality of suction openings formed therein.

4. The attachment device as recited in claim 3, wherein the suction openings divide the roller cover into sections at least approximately equal in length.

5. The attachment device as recited in claim 3, wherein the roller cover has two suction openings formed therein.

6. The attachment device as recited in claim 3, wherein the suction openings are connected to a common suction air outlet by an air duct.

7. The attachment device as recited in claim 1 wherein the gear housing is ring-shaped.

8. The attachment device as recited in claim 2, wherein the gear housing is ring shaped and received by the roller cover.

9. The attachment device as recited in claim 8, wherein the roller cover is U-shaped in cross section.

10. The attachment device as recited in one of claim 1, wherein the roller is of two-part construction including two roller parts and the gear housing is disposed between the roller parts.

11. The attachment device as recited in claim 10, wherein the roller parts are at least approximately equal in length.

12. The attachment device as recited in claim 1, wherein the motor shaft or the drive shaft drives the roller via a gear mechanism.

13. The attachment device as recited in claim 12, wherein the gear mechanism is disposed in the gear housing.

14. The attachment device as recited in claim 12, wherein the gear mechanism is configured to rotate both roller parts in the same direction.

15. The attachment device as recited in claim 1, wherein the bristles or agitator portions adjacent to the gear housing point toward the motor shaft or the drive shaft.

16. The attachment device as recited in claim 15, wherein the bristles or agitator portions adjacent to the gear housing contact the motor shaft or the drive shaft during rotation of the roller.

17. The attachment device as recited in claim 12, wherein parts of the gear mechanism extend at least partially into the roller.

18. The attachment device as recited in claim 17, wherein gears of the gear mechanism extend at least partially into the roller.

* * * * *